US005232161A

United States Patent [19]

Clemmons

[11] Patent Number: 5,232,161

[45] Date of Patent: Aug. 3, 1993

[54] TEXTURE MATERIAL APPLICATION DEVICE

[75] Inventor: George E. Clemmons, Blue Springs, Mo.

[73] Assignee: Goldblatt Tool Company, Kansas City, Kans.

[21] Appl. No.: 699,275

[22] Filed: May 13, 1991

[51] Int. Cl.[5] ..... B05B 7/30; B05B 7/02

[52] U.S. Cl. ..... 239/346; 239/345; 239/394; 239/526; 251/98

[58] Field of Search ..... 239/526, 409, 346, 391, 239/392, 393, 394, 525, 345; 251/89, 100, 95, 98, 99

[56] References Cited

U.S. PATENT DOCUMENTS

| | | | |
|---|---|---|---|
| 1,892,260 | 12/1932 | Wick | 251/95 |
| 1,964,807 | 7/1934 | Baum | 239/394 |
| 2,557,606 | 6/1951 | Liedberg | 239/526 |
| 3,596,835 | 8/1971 | Smith | 239/394 |
| 4,288,036 | 9/1981 | Jubinville | 239/346 |
| 4,434,939 | 3/1984 | Stankowitz | 239/391 |
| 4,502,640 | 3/1985 | Nonis | 239/346 |
| 4,863,104 | 9/1989 | Masterson | 239/346 |

FOREIGN PATENT DOCUMENTS

| | | | |
|---|---|---|---|
| 160260 | 8/1953 | Australia | 251/98 |
| 1537304 | 1/1990 | U.S.S.R. | 239/526 |
| 427586 | 4/1935 | United Kingdom | 251/98 |

*Primary Examiner*—Andres Kashnikow
*Assistant Examiner*—Christopher G. Trainor
*Attorney, Agent, or Firm*—Laff, Whitesel, Conte & Saret

[57] ABSTRACT

A texture material applicator device according to the present invention comprises a barrel for supporting a hollow shaft. The shaft is mounted on bearings for rotation about a central axis and for longitudinal translation along the axis. A supply of compressed air is provided to the shaft. The compressed air is expelled from the front end of the shaft at high speed. A supply of texture material to be applied to a surface is extruded into the barrel from a manifold near the front of the shaft. The shaft is movable longitudinally from an "off" position, in which the stream of expelled air does not strike the texture material, to an "on" position, in which the stream of air does strike the texture material. A trigger member extending through a slot in the barrel is provided so that an operator may control the longitudinal position of the shaft. In addition, the trigger member may rotate about the axis of the shaft. The slot has one or more notches in its side walls for maintaining the trigger member in a selected position without requiring continued operator pressure, allowing continued application of the texture material.

6 Claims, 2 Drawing Sheets

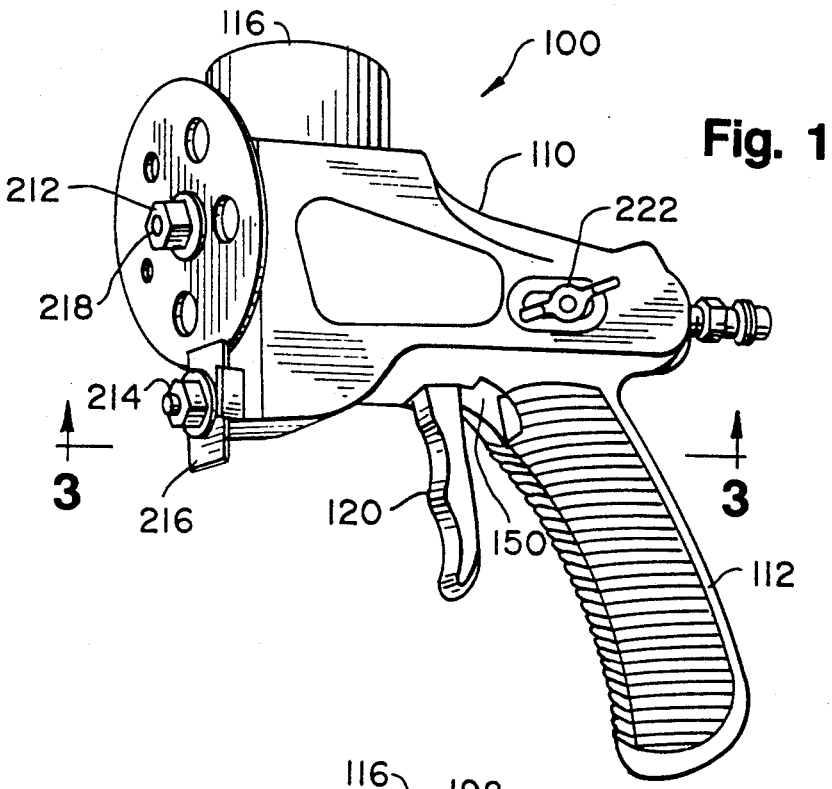
Fig. 1
Fig. 2
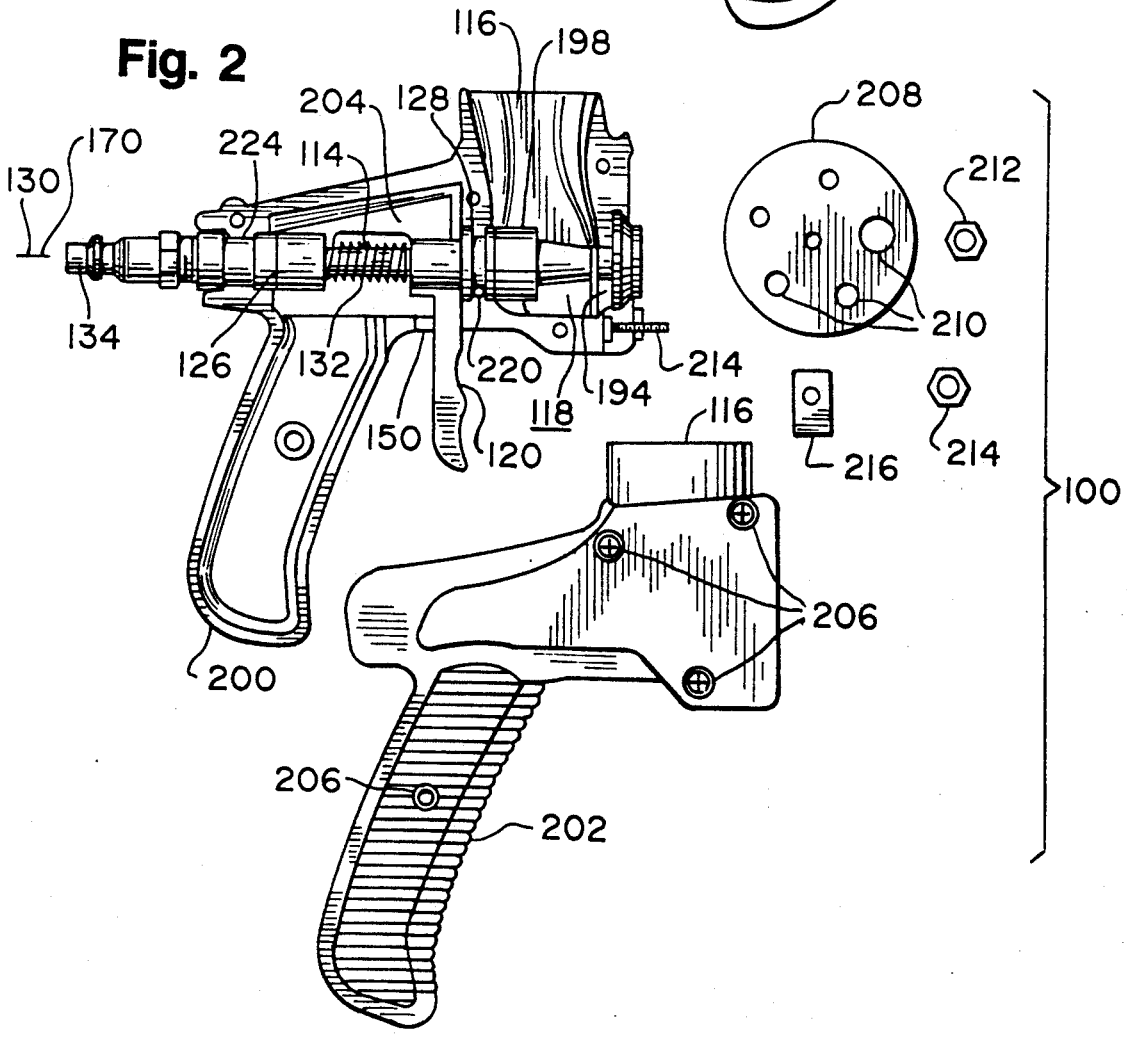

TEXTURE MATERIAL APPLICATION DEVICE

BACKGROUND OF THE INVENTION

This invention relates to devices for applying texture material to surfaces, and more particularly to such devices having a spring-loaded trigger where it is desired to maintain the trigger in a consistent position during application.

A variety of devices are available for applying texture material to surfaces, such as the wall and ceiling of a building. While such material could be applied using manual tools, manual application generally does not provide a desired consistent pattern of material. Accordingly, automated tools have been developed to direct a consistent stream or spray of texture material at a desired surface. Such devices have been constructed in the general design of a spray gun having a mechanical trigger which the operator holds in a predetermined position to cause the gun to emit the texture material.

A problem with the existing spray gun devices is excessive operator discomfort and fatigue due to the need to maintain the trigger in an "on" position. A resilient member, such as a spring, is typically provided to urge the trigger to the "off" position whenever the operator is not actively holding it in the "on" position. This eliminates the need for the operator to actively move the trigger into the "off" position.

In order to provide sufficient force to move the trigger to the "off" position, the resilient member selected in these applications is relatively stiff. As a result, when moving the trigger levers of the prior art devices to the "on" position, the operator must provide a substantial amount of force to overcome the resilient member, and the operator must continue to provide this force as long as he desires to apply the texture material. Because applicator devices of this type are generally designed for use by tradespeople in the construction industry for large areas, many operators use the devices for extended periods of time. The need to apply substantial force to the trigger lever for extended periods causes discomfort and fatigue to the operators.

One solution to this problem might be to employ a resilient member having less stiffness in order to reduce the amount of force that an operator must supply to move the trigger member into the "on" position and maintain it there. However, reducing the stiffness of the resilient member enough to substantially reduce operator fatigue results in insufficient force from the resilient member to return the trigger to the "off" position upon release by the operator.

SUMMARY OF THE INVENTION

It is therefore an object of the present invention to provide a device for applying texture material to surfaces which eliminates the need for an operator to apply continuous force to maintain the trigger lever in the "on" position.

It is another object of the invention to provide a device for applying texture material to surfaces which reduces operator discomfort and fatigue.

A texture material applicator device according to the present invention comprises a barrel containing a hollow shaft. The shaft is mounted on bearings for rotation about a central axis and for longitudinal translation along the axis. A supply of compressed air is provided to the shaft. The compressed air is expelled from the front end of the shaft at high speed. A supply of texture material to be applied to a surface is extruded into the barrel from a manifold near the front of the shaft. The shaft is movable longitudinally from an "off" position, in which the stream of expelled air does not strike the texture material, to an "on" position, in which the stream of air does strike the texture material. When the air stream strikes the texture material, it shears the material into particles which are then carried by the stream to the desired surface. A resilient member urges the shaft towards the off position.

A trigger member is provided so that an operator may control the longitudinal position of the shaft. The trigger member extends outside of the barrel through a trigger traversal slot which extends longitudinally along the barrel. The trigger member is attached to the shaft so that as the trigger member is moved longitudinally, it causes longitudinal movement of the shaft. In addition, the trigger member may rotate about the axis of the shaft. The trigger traversal slot has one or more notches in its side walls for maintaining the trigger member in a desired position without requiring continued operator pressure. The operator may apply force to overcome the pressure of the resilient member and longitudinally displace the trigger member from the "off" position to a desired "on" position, and may then rotate the trigger member slightly about the shaft axis to lodge it in a notch of the trigger traversal side wall at that longitudinal position.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 1 is an oblique perspective view of a texture material applicator device constructed according to the present invention, shown with the trigger in its normal, non-operating position;

FIG. 2 is a side elevation view of the texture material applicator of FIG. 1, shown partially disassembled to reveal interior parts;

DETAILED DESCRIPTION OF THE PREFERRED EMBODIMENT

Figure 3:
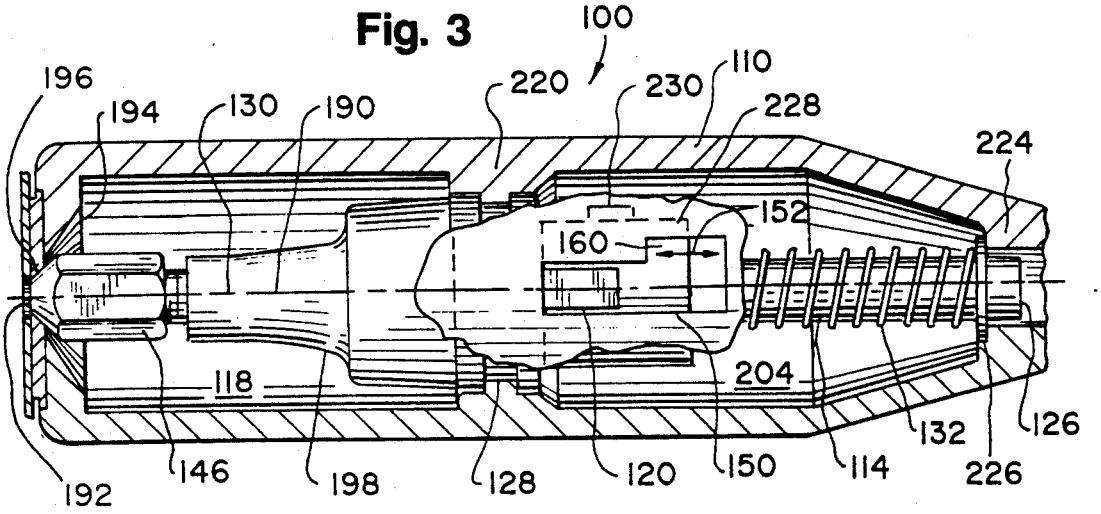
FIG. 3 is a bottom elevation view of the texture material applicator of FIG. 1, shown with the trigger in its normal, non-operating position, and with some of the housing material cut away to reveal interior parts.

A preferred embodiment of a device 100 for applying texture material to walls and ceilings constructed according to the present invention is shown generally in FIGS. 1–4. The applicator device 100 may be constructed as a gun-shaped spraying device having a barrel 110 attached to a handle 112. The barrel 110 may have any appropriate shape. For example, as shown herein, the barrel 110 is generally tubular in shape. The barrel 110 has a longitudinal axis 190 which essentially defines the direction the applicator is pointing.

As best seen in FIG. 2, the applicator 100 may be constructed having first and second housing pieces 200, 202 which may be assembled together to define a suitable housing. Once assembled, first and second housing pieces 200, 202 may be retained together by suitable fasteners 206, such as screws. The housing walls define a front chamber 118 and a rear chamber 204. The front and rear chambers are separated by a front bulkhead 220. The rear chamber 204 has a rear bulkhead 224. The front chamber 118 has a front wall 194 with an opening 196 (FIGS. 3, 4) from which texture material to be applied to a surface may be ejected.

A pattern definition plate 208 is preferably provided on the front of the applicator to control the size of the plume of ejected texture material. The plate 208 contains a plurality of apertures 210 of various sizes. The plate 208 is mounted on the front of the applicator and is adapted for rotation about an axle 218 so that a selected one of the apertures 210 may be positioned over the front wall opening 196. A clamping plate 216 rotationally fixes the position of the plate 208. Suitable fasteners 212, 214 releasably secure pattern plate 208 and clamping plate respectively to the applicator device 100.

Figure 4:
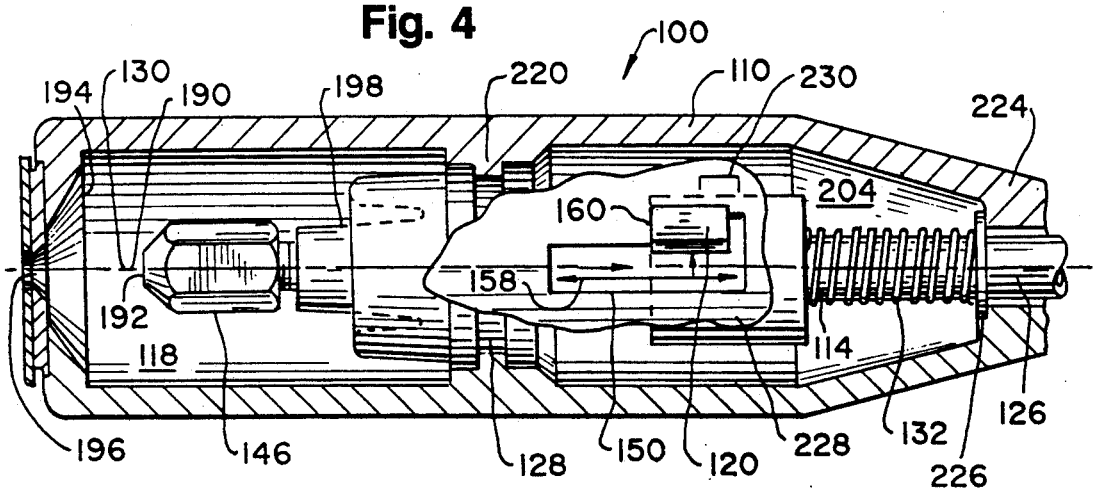
FIG. 4 is a bottom elevation view of the texture material applicator of FIG. 1, shown with the trigger in its operating position and with some of the housing material cut away to reveal interior parts.

The barrel 110 houses a hollow shaft 114. Shaft 114 is preferably mounted on suitable front and rear bearing means 128, 126 for rotation about an axis 130. Axis 130 may conveniently be oriented to coincide with the longitudinal axis 190 of the barrel 110, as shown in FIGS. 2–4. However, non-coincident orientations of axes 130 and 190 would also be suitable. For example, axis 130 could be displaced linearly or angularly from axis 190. Front bearing means 128 is mounted in an aperture in the separating front bulkhead 220. Rear bearing means 126 is mounted in an aperture in the rear bulkhead 224. Bearing means 126, 128 also permit longitudinal motion of the shaft 114 parallel to the central axis 130.

A trigger member 120 controls the longitudinal position of the shaft 114. The trigger 120 is mounted for longitudinal movement along a slot 150 in barrel 110 and is suitably attached to shaft 114 so that such longitudinal movement of the trigger 120 causes corresponding movement of the shaft 114. In addition, however, the mounting arrangements for trigger 120 and shaft 114 also permit limited rotation of the trigger 120 about the central axis 130 of shaft 114. Thus, shaft 114 has two degrees of freedom: rotation about central axis 130 and longitudinal movement along that axis. Trigger 120 also has two degrees of freedom: rotation about central axis 130 and longitudinal motion within slot 150 substantially parallel to axis 130.

Trigger member 120 extends outside of barrel 110 through trigger traverse slot 150 to permit a use of the applicator device 100 to operate the trigger by moving it longitudinally along slot 150. Shaft 114 may occupy a continuum of positions from a forward-most position best seen in FIG. 3, to a rear-most position best seen in FIG. 4. An appropriate resilient means 132, such as a spring, urges shaft 114 to a the forward-most position. An appropriate transport medium, such as compressed air, is supplied to shaft 114 under pressure through a supply line or fitting 134 (FIG. 1), and is expelled from a nozzle 146 (FIGS. 3–4) at the front end of the shaft 114. As best seen in FIG. 2, supply fitting 134 is preferably pneumatically connected to rear bearing 126 so that transport medium may flow through the bearing 126 into shaft 114. A seal 226 (FIGS. 3–4) seals the front end of rear bearing 126 to the shaft 114 to prevent excessive leakage of the transport medium.

Texture material to be applied by the device 100 is delivered to a suitable manifold 116 (FIGS. 2–4) through a supply line (not shown). The manifold 116 is positioned near the front end of barrel 110 and leads into front chamber 118 surrounding the front portion of shaft 114 and its nozzle 146. The chamber 118 is defined by the walls of the barrel 110, a front chamber wall 194, and the separating bulkhead 220. A suitable seal 198 extends between shaft 4 and the barrel walls. Seal 198 may be constructed as a rubber "boot" so that the seal remains intact and operative despite translation and rotation of shaft 114.

As best seen in FIGS. 3–4, when shaft 114 is in its forward-most position, the output orifice 192 of the nozzle 146 protrudes through opening 196 of front wall 194. As a result, any texture material (not shown) which may be present in the front chamber 118 is protected from contact with the transport medium being expelled from nozzle 146. However, when shaft 114 is in its rear-most position, the output orifice 192 of nozzle 146 is retracted substantially behind the front wall 194 of chamber 118. Texture material extruded into the chamber 118 from manifold 116 is struck by the plume of transport media expelled from shaft 114 and is sheared off into small chunks or droplets. The texture material is carried by the transport medium in a spray which is expelled out of opening 196 and toward a surface (not shown) to which the material is to be applied.

A suitable mounting arrangement for mounting trigger member 120 to shaft 114 is shown in FIGS. 2–4. The trigger member 120 preferably has an attachment collar 228 having an aperture of sufficient size to accommodate shaft 114. The attachment collar 228 preferably includes means 230 for attaching the collar 228 at a fixed position with respect to the shaft. For example, means 230 may be a setscrew which penetrates the side of the collar 228 to produce secure frictional engagement between the collar 228 and the shaft 114.

The trigger traversal slot 150 has a longitudinal trigger operating channel 158 (FIG. 3) to accommodate longitudinal displacements of the trigger member 120. In order to maintain the trigger member 120 in an "on" position, the trigger traversal slot 150 preferably includes at least one notch in its side walls. For example, as best seen in FIGS. 3–4, the slot 150 may comprise a trigger capture notch 152 which extends transverse to the channel 158. As best seen in FIGS. 3–4, the trigger member 120 may be moved as required within channel 158 until it reaches the trigger capture notch 152, and then may be rotated slightly about axis 130 to lodge in the notch.

In FIG. 4, the trigger member 120 is shown lodged in the notch 152. Once positioned in the notch 152 by the operator, the trigger member is urged forward by resilient member 132 to rest against the front wall 160 of the notch. Friction between the trigger member 120 and the notch front wall 160 prevents the trigger member 120 from rotationally slipping out of the notch to return to the channel 158. Therefore, once the trigger member 120 is placed in the notch by the operator, the trigger member 120 will remain there until the operator provides force to rotate 1 the trigger member 120 out of the notch and into the channel. While only a single notch is shown in the drawings, additional notches could be provided in the same or the opposite trigger traversal channel wall to permit the operator to select from one of several stable trigger positions.

A trigger stop 222 (FIG. 1) protrudes through the housing into rear chamber 204 to limit the extent of travel of the trigger member 120. The trigger stop 222 is preferably adapted for longitudinal movement along a range of possible trigger positions, and preferably may be releasably secured at various positions. The trigger stop 222 mechanically interferes with the trigger attachment collar 228 to prevent movement of the trigger beyond a preselected position. For example, it may be desirable at times to prevent the trigger from locking, such as when a touch-up operation is necessary.

Although a specific arrangement has been described above for mounting the trigger member 120 to the shaft 114, other arrangements could also be used to achieve the benefits of the present invention. In general, a trigger mounting arrangement will be suitable provided that the arrangement permits trigger member 120 to cause translation of the shaft 114, and provided that the arrangement can withstand the moment forces produced when a user actuates the trigger member 120. In particular, although the above-described mounting arrangement rotationally fixes the trigger member with respect to the shaft, it is not required that the shaft rotate with the trigger. A mounting arrangement which permits the the trigger to rotate while the shaft remains rotationally fixed would also be suitable. Alternatively, the trigger member need not rotate with respect to the axis of the shaft. The trigger could be mounted for longitudinal displacements (e.g. sliding) to control the shaft position, and for transverse displacements to engage trigger capture notch 152.

The above-described embodiment of the invention is merely one example of a way in which the invention may be carried out. Other ways may also be possible, and are within the scope of the following claims defining the invention.

What is claimed is:

1. A device for applying texture material to a surface comprising:

a barrel for receiving and expelling texture material, said barrel having a longitudinal axis;

a trigger member extending from an interior position in said barrel to the exterior of said barrel, said trigger member having a first end within said barrel and a second end outside of said barrel, said trigger member being mounted for movement both parallel and rotationally to the longitudinal axis of said barrel;

a shaft within said barrel for supplying a transport medium to said texture material received by said barrel, thereby permitting the flow of texture material from said barrel, said shaft mounted for rotation about a rotational axis substantially parallel to said barrel longitudinal axis, said shaft also mounted for movement substantially parallel to said shaft rotational axis, said rotational and longitudinal movement of said shaft controlled by movement of said trigger member;

retaining means within said barrel, said retaining means engageable by said first end of said trigger member when said trigger member is rotated relative to said longitudinal axis of said barrel, thereby maintaining said trigger member and said shaft in a first position for permitting expulsion of texture material from said barrel; and resilient means responsive to said trigger member for urging said shaft toward a second position prohibiting the expulsion of texture material.

2. The device of claim 1 wherein said retaining means comprises a notch extending from a slot in said barrel.

3. The device of claim 1 wherein said trigger member can move said shaft between said first and second positions.

4. A texture material applicator comprising:

a barrel for receiving and expelling texture material, said barrel having a side wall and a longitudinal axis, said side wall having a slot therein, said slot having at least one notch extending transversely to the longitudinal axis of said barrel;

a shaft within said barrel for supplying a transport medium to said texture material received by said barrel, said shaft mounted for movement substantially parallel to the longitudinal axis of said barrel and for rotation about an axis of rotation substantially parallel to said barrel longitudinal axis;

a trigger member operatively connected to said shaft and mounted for coincidental movement therewith, said trigger member having a first end extending into said slot and engageable therewith, said trigger member being operable to selectively move said shaft into a position which stops the flow of texture material expelled from said barrel, or into a position which permits the expulsion of texture material from said barrel, said trigger member locking said shaft into said texture material expulsion position when said first end of said trigger member engages said notch, said trigger member also having a second end extending outside said barrel and remote from said slot, said trigger member being moveable substantially parallel to said longitudinal axis of said barrel and rotationally about said axis of rotation substantially parallel to said barrel longitudinal axis.

5. The applicator of claim 4 and resilient means operatively connected to said trigger member for urging said shaft toward the position which stops the flow of texture material.

6. The applicator of claim 4 wherein said notch includes a front wall for frictionally engaging said trigger member and limiting movement of said trigger method from said notch.

* * * * *

UNITED STATES PATENT AND TRADEMARK OFFICE

CERTIFICATE OF CORRECTION

PATENT NO. : 5,232,161

DATED : August 3, 1993

INVENTOR(S) : CLEMMONS, GEORGE E.

It is certified that error appears in the above—identified patent and that said Letters Patent is hereby corrected as shown below:

COL. 4, LINE 6, "shaft 4"
should be --shaft 114--;

COL. 4, LINE 59, "rotate 1"
should be --rotate--;

COL. 3, LINE 55, "a the"
should be --the--;

COL. 3, LINE 58, "fitting
134 (Figure 1)" should be
--fitting 134 (Figure 2)--

COL. 5, LINE 21, "the the"
should be --the--.

Signed and Sealed this

Seventeenth Day of May, 1994

Bruce Lehman

*Attest:*

BRUCE LEHMAN

*Attesting Officer*

*Commissioner of Patents and Trademarks*